US006152336A

United States Patent [19]

Arvedi et al.

[11] Patent Number: 6,152,336

[45] Date of Patent: Nov. 28, 2000

[54] SUBMERGED NOZZLE FOR THE CONTINUOUS CASTING OF THIN SLABS

[75] Inventors: Giovanni Arvedi, Via Mercatello, 26 Cremona; Luciano Manini, Azzanello; Andrea Bianchi, Piadena, all of Italy

[73] Assignee: Giovanni Arvedi, Cremona, Italy

[21] Appl. No.: 09/194,687

[22] PCT Filed: Jun. 16, 1997

[86] PCT No.: PCT/IT97/00135

§ 371 Date: Dec. 1, 1998

§ 102(e) Date: Dec. 1, 1998

[87] PCT Pub. No.: WO97/48512

PCT Pub. Date: Dec. 24, 1997

[30] Foreign Application Priority Data

Jun. 19, 1996 [IT] Italy ..... MI96A1243

[51] Int. Cl.[7] ..... B22D 41/50

[52] U.S. Cl. ..... 222/594; 222/606

[58] Field of Search ..... 222/594, 606, 222/607; 164/437, 335, 337

[56] References Cited

U.S. PATENT DOCUMENTS 5,681,498 10/1997 Poloni et al. ..... 222/594

5,716,538 2/1998 Poloni et al. ..... 222/606

FOREIGN PATENT DOCUMENTS 0 694 359 A1 1/1996 European Pat. Off. .

41 42 447 A1 12/1992 Germany .

44 36 990 C1 12/1995 Germany .

WO 89/12519 12/1989 WIPO .

WO 95/29025 11/1995 WIPO .

*Primary Examiner*—Scott Kastler

*Attorney, Agent, or Firm*—Akin, Gump, Strauss, Hauer & Feld, L.L.P.

[57] ABSTRACT

A dip pipe (1) which feeds by gravity with a molten metal or alloy (2) from a ladle (3) a slab (4) being formed in a thin mold (5) with cooling walls comprises a length of vertical pipe (6) communicating with the upper ladle (3) and downwards ending into a diffuser (8) of flattened shape having two discharge holes (9, 9'). According to the invention the diffuser (8) has a central partition baffle (14) designed to define two channels (16, 16') for the flow and corresponding to said two discharge holes (9, 9'), and the cross-section area (10) of the flow at the highest level of the diffuser is less than the cross-section area (11) of the pipe (6). Furthermore the inner side walls (12, 12') of the diffuser, which are directed to the narrow sides of the thin mold, form each an angle $\alpha \leqq 7.5°$ with the vertical axis (13) while departing therefrom in the downward direction, the flow partition baffle (14) narrowing in its lower portion to form two angles $\beta \leqq 7.5°$ with vertical axis (13).

7 Claims, 1 Drawing Sheet

Fig. 1
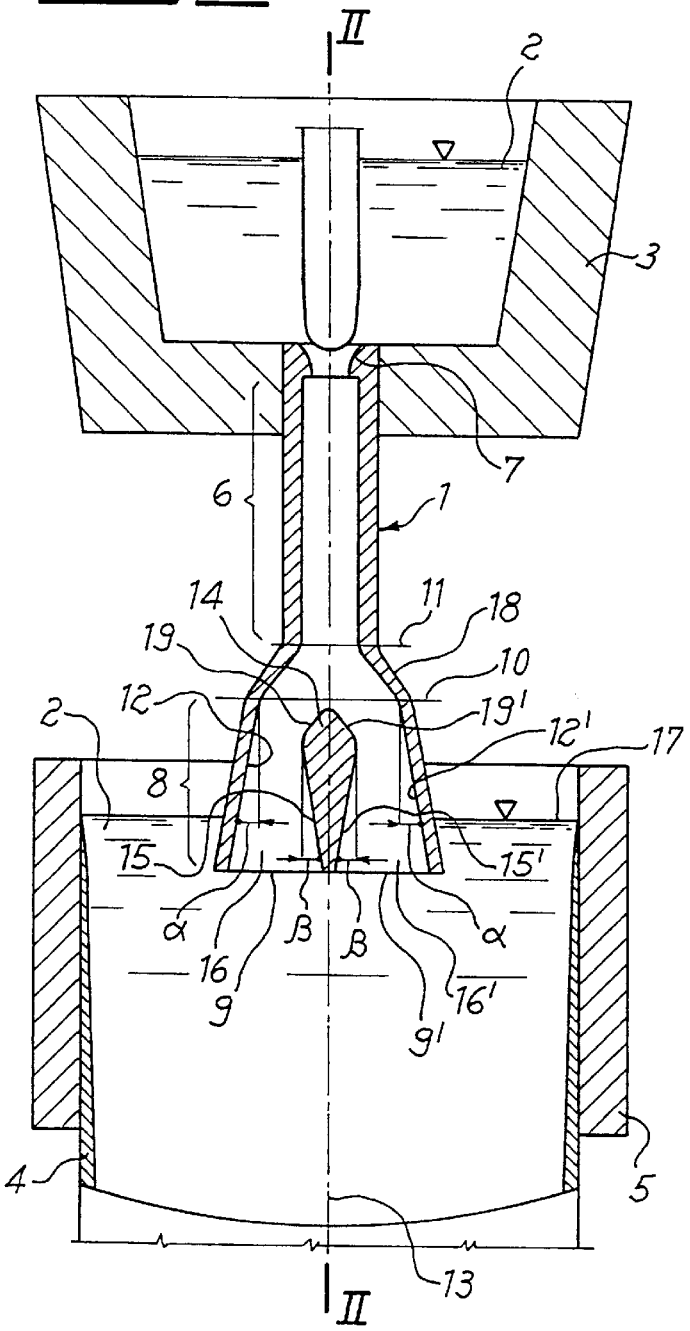
Fig. 2
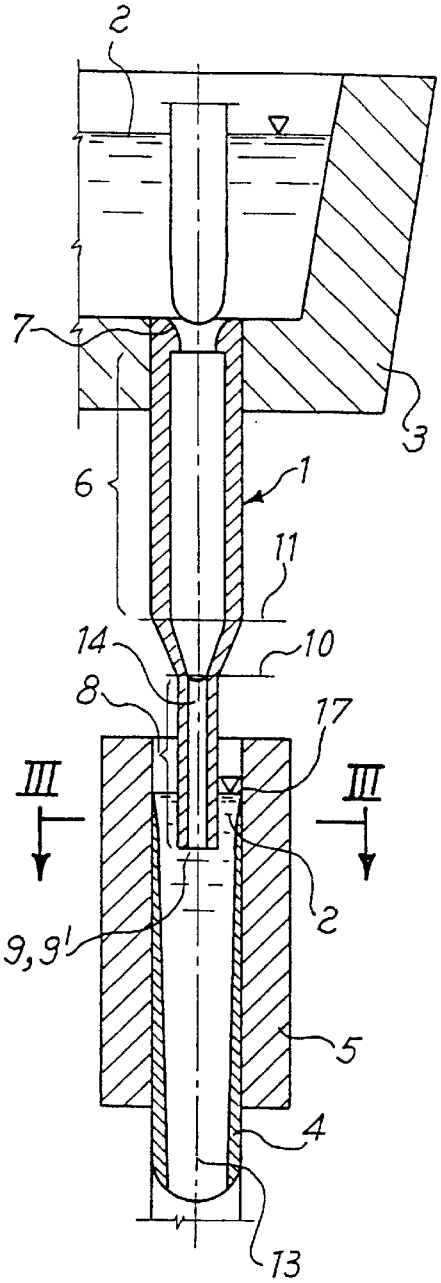
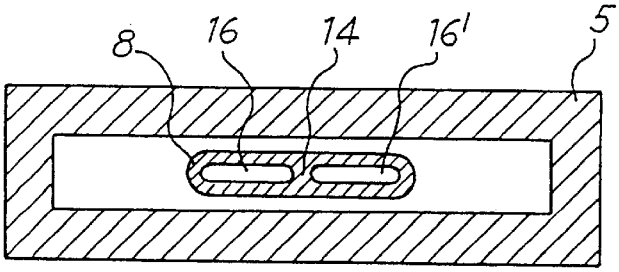
Fig. 3

SUBMERGED NOZZLE FOR THE CONTINUOUS CASTING OF THIN SLABS

The present invention relates to a feed dip pipe for the continuous casting of thin slabs and more in particular a submerged nozzle for guiding in the best way as possible a molten metal or alloy from a ladle having a nearly constant head for feeding the same, without turbulence or swirling, to a level underneath the head or meniscus of a slab being formed within a cooling mould in which the slab itself takes a shape by solidification.

Thin slabs are known which are formed of four walls extending in vertical direction with horizontal cross-section having two sides of prevailing length with respect to the other two. It is also known that for introducing molten metal, especially steel, fed from a vessel above, into the inside of the mould, a connection conduit is used, being called "submerged", as its lower mouth is dipped in the molten bath within the mould and is adapted as much as possible to the thin size of the same mould in order to keep a sufficient distance from the cooling walls. Therefore dip pipes for thin slabs are usually employed in the technique as having in the lower portion horizontal cross-section of rectangular, polygonal or elliptical shape, with outlet boards directed the narrow sides and/or downwards.

However these prior art dip pipes do not solve the various problems; which are typical of this technology, as are widely described in the literature in this field and due to various reasons. In particular the fluid stream flowing out from the dip pipe has the tendency to circulate within the liquid mass in the core of the forming slab, solidified only externally, while having the attitude to re-emerge to the surface, thus generating stationary waves at the bath surface, especially in the proximity of the narrow faces of the thin mould. Thereby the lubricating slag will generally gather in the lower portions of the wave-shaped meniscus, while leaving the picks uncovered, with consequent lack of lubrication or poor distribution thereof, which gives rise to mould wear as well as a poor surface quality of the slab and incorrect thermal exchange of the forming slab with the mould, that is a cause of possible cracks.

Furthermore, the zones where the fluid swirls come back again into the liquid bath show a marked bent of the meniscus, in which the particles of powder and lubricating slag are easily entrapped in the forming slab, thus providing an additional cause of cracks and other surface defects. The turbulence at the level of meniscus in the mould is also an important cause of wear for the nozzle the life of which is then reduced.

Possible turbulence and whirlpools in the fluid stream at the outlet of the nozzle have a negative influence on the solidification process occurring within the slab, which should be progressive and as homogeneous as possible in the direction parallel to the narrow faces of the mould. On the contrary steadiness of feed and a distribution as symmetrical as possible of the flow with respect to the longitudinal axis of the slab, with the maximum of homogeneity at the horizontal cross-sections would be desirable.

Mention is made of the additional inconvenience due to the fact that oxides are present in the molden metals or alloys and have the tendency to deposit on the inner surfaces of the nozzle thus modifying its geometry and hence negatively effecting the passage cross-sections of flow.

Except for the last mentioned inconvenience, which becomes worse in case of slow flow rates in the various passage cross-sections, all the other inconveniences previously mentioned worsen as the flow rate of molten metal or alloy increases, namely in correspondence with higher speeds at which the slab being formed in the mould is withdrawn and/or larger cross-section areas of the slab, thereby higher flow rates in the various passage cross-sections, in particular at the discharge holes.

Anyhow all these mentioned inconveniences are present in whichever known shape of dip pipe or nozzle thus negatively affecting in various ways the correct trend of the casting and of the cooling of the slab under formation with a consequence of having a final product of poor quality.

Therefore it is an object of the present invention to provide a feed dip pipe or nozzle that can overcome the mentioned drawbacks by reducing as much as possible and gradually the flow rate passing through the cross-sections in correspondence of gradually decreasing distances from the discharge holes, thus obtaining a stabilized stream, symmetrical with respect to the vertical axis, with a kinetic energy which can be more easily dissipated within the liquid core of the slab being formed, and reducing to the minimum the presence of whirls and turbulence in the meniscus. Within the dip pipe the flow is accelerated until a point of cross-section reduction and then it is evenly slowed down while maintaining the lower portion of the diffuser filled with liquid.

This object is obtained by means of a dip pipe or nozzle having the features recited in claim 1. The subsequent claims are directed to preferred and alternative embodiments of the nozzle according to particular aspects of the present invention.

These and additional objects, advantages and features of the dip pipe or nozzle according to the invention will appear more clearly to those skilled in the art from the following description of a non-limiting preferred embodiment of the invention itself, with reference to the drawings in which:

FIG. 1 shows a longitudinal, sectional view of the nozzle according to the invention being immersed in a thin mould, taken in a median plane, parallel to the large faces of the mould itself;

FIG. 2 shows a longitudinal sectional view of the nozzle immersed in the mould, taken along a plane II—II parallel to the narrow faces of the mould; and FIG. 3 shows a sectional view along the line III—III of FIG. 2.

With reference to FIG. 1, a dip pipe 1 feeds by gravity with a molten metal or alloy 2, contained in an upper ladle 3 having a nearly constant head, a slab 4 being formed at the inside of a thin mould 5, with cooling walls and formed of four walls extending in a vertical direction with a horizontal cross-section wherein two sides are of prevailing length with respect to the other two. Although shown in FIG. 3 as having a perfectly rectangular cross-section, the mould can have slightly convex or polygonal walls or even with a longitudinal trend slightly different from the perfectly vertical one represented in FIG. 2, without departing from the features of the dip pipe according to the invention.

The dip pipe comprises a length of vertical pipe of a circular cross-section, being connected to the upper ladle 3 in a known way. The dip pipe can be provided, at its upper portion, with a flow control surface 7, while downwards extends itself, through a fitting zone 18, with a flattened distributing portion, in the following called diffuser 8, having lower discharge 9, 9'. The diffuser 8 provides for feeding the molten material under the head 17, from which the term "dip" or "submerged", at the inside of the slab 4 being formed in the thin mould 5 while keeping a given distance from the walls of the mould itself. The slab 4 being formed as being represented with solid walls of increasing thickness from the top to the bottom, while the inner core must be still considered liquid or however not yet completely solidified.

In the diffuser zone 8 a central baffle 14 is also provided, integral to both the larger walls of the diffuser, suitable to divide the flow in two distinct conduits 16, 16' ending with the two holes 9, 9' for discharging downwards.

The flow passage cross-section 10, at the highest level of the diffuser height, at the end of the fitting portion 18 with the pipe 6, has been preferably represented coincident with the upper end of the baffle 14 although this is not an essential feature of the invention.

According to the present invention, the area of such a cross-section 10 is less than that corresponding to the cross-section area of the upper pipe 6, which has been indicated with reference numeral 11. This condition is better shown in FIG. 2. It will be noted that, in spite of the fact that the side walls of fitting 18 appear to diverge downwards in FIG. 1, i.e. at the cross-section parallel to the large faces of the mould, in all the other sectional planes their are convergent, thus giving rise to a reduction of cross-section in the downward direction.

Furthermore the inner side walls 12, 12' of the diffuser 8 towards the narrow sides of the thin mould 5 are diverging downwards and form each with a vertical axis 13 from which they depart an angle $\alpha$ that is less than or equal to 7.5°.

Still according to the invention, the flow partition baffle 14 is narrowing in its lower portion 15, 15' along the sides facing the narrow sides of the thin mould 5, by forming with the vertical axis 13 to angles $\beta \leqq 7.5°$. It should be appreciated that angles $\beta$ can be equal or different from angles $\alpha$, provided that the above-mentioned conditions are met.

The two passage conduits 16, 16' which-consequently are formed from opposite sides of the partition baffle 14, have a cross-section at right angles with the flow that is increasing in a downwards direction, but without making easier a flow detachment from the walls. Owing to the restriction imposed to angles $\alpha$ and $\beta$, a flow separation is avoided and the flow rate along the two conduits 16, 16' results to be the maximum technically obtainable in relation to the desired speed of outflow from the discharge holes 9, 9'.

Under the hydrodynamic aspect, the dip pipe or nozzle according to the invention is substantially like it would present to the flow of molten material a compression chamber in correspondence with the cross-section 11, more precisely between the latter and the reduced cross-section 10. Subsequently the flow has its maximum acceleration, then slowing down downstream, starting from cross-section 10, gradually along the two conduits 16, 16', but still preserving the continuity of contact with the walls. However it is convenient that the flow rate is still accelerated along the upper portion, with diverging faces of the baffle 14 in order to keep clear both conduits 16, 16' of any deposit of oxides, such a deposit already occurring in this zone at the presence of an excessive or too early slowing down of the flow. For this purpose it is preferable that the cross-section area of both conduits 16, 16' is still decreasing between the highest cross-section 10 of the diffuser and that of the maximum width of the baffle. It would be possible to obtain such a condition e.g. by imposing for the above-mentioned upper zone of the baffle 14, assuming that said edges 19, 19' are provided as shown in FIG. 1, that these are inclined by an angle $\geqq \alpha$. In this way the two upper zones of conduit 16, 16', where start to form by departing about the upper edges 19, 19' of baffle 14 will be slightly convergent before starting of the divergent zone in the actual diffuser 8.

Possible additions and/or modifications can be made by those skilled in the art with respect to the above described and illustrated embodiment of the dip pipe according to the present invention without exceeding the scope of the invention itself. In particular the dip pipe 1, instead of being provided with a flow control surface 7, as indicated in FIGS. 1 and 2, could be directly flanged in a way per se known to the bottom of ladle 3, while the flow control surface could be provided on a different member, placed within the ladle itself. In an alternative solution the pipe 1 could also be flanged, again in a way per se know, under a "drawer" of flow control placed on the bottom of ladle 3, acting in a known way by choking at the passage port between two holed and facing plates feeding one above the other.

What is claimed is:

1. A dip pipe for feeding by gravity, a molten metal or alloy (2) from a ladle (3) having a nearly constant head, into a thin mould to thereby form a slab (4) from a bath with a top surface (17) in the thin mould (5), the mould (5) comprising first, second, third and fourth cooling walls extending in a substantially vertical direction, with a horizontal cross-section of the mould (5) formed by the first and second walls opposing each other and having a length much greater than the third and fourth walls which oppose each other; the dip pipe (1) comprising a vertical upper tube (6) for communication with the upper ladle (3) and, a diffuser (8) connected to the upper tube (6), the diffuser 8 including a partition baffle (14) forming two distinct passages (16, 16') with discharge holes (9, 9'), respectively, at a lower end of the diffuser (8) opening under the top surface (17) of the slab (4) at a given distance from the mould (5) walls, wherein an upper end of the diffuser (8) has a cross sectional area (10) which is smaller than a cross sectional area (11) of the upper tube (6); said diffuser (8) having inner side walls (12, 12') facing the third and fourth walls of the mould (5), said diffuser inner side walls (12, 12') symmetrically diverging downwardly away from a vertical axis (13) extending through the upper tube (6) and diffuser (8) at an angle $\alpha \leqq 7.5°$ with respect to said axis; and a lower portion of the partition baffle (14) having side walls (15, 15') that symmetrically converge downward toward the vertical axis (13) at an angle $\beta \leqq 7.5°$ with respect to the vertical axis (13) and extend away from the inner side walls (12, 12') toward the discharge openings (9, 9'), respectively, wherein flow of the molten metal or alloy is gradually reduced in the diffuser (8) toward the discharge holes (9, 9') to thereby produce two diverging, dynamically stable symmetric flows that discharge into the bath below the top surface (17).

2. A dip pipe according to claim 1, wherein said partition baffle (14) extends from the the lower end of said diffuser (8), at the same level of said discharge holes (9, 9'), up to said cross-sectional area (10) of the diffuser (8) to form the two passages (16, 16') with a cross sectional area that increases from an upper portion of said baffle downwards in a direction perpendicular to the flow of molten metal or alloy, at least from a zone where said baffle has the greatest width, where said side walls (15, 15') of said baffle start approaching the vertical axis (13).

3. A dip pipe according to claim 2, wherein the upper end of said baffle (14), substantially at the same level as said cross sectional area (10) of said diffuser (8), is connected to the upper tube (6) through a tapered fitting zone (18); and further wherein the partition baffle (14) comprises upper side walls (19, 19') that diverge downwardly toward the side walls (15, 15') of the partition baffle, respectively, from said upper end at a zone of greatest width of the baffle (14).

4. A dip pipe according to claim 3, wherein the diverging upper side walls (19, 19') of said baffle (14) form an angle $\geqq\alpha$ with the vertical, whereby an initial portion of said passages (16, 16') has a constant or decreasing cross-section with the flow of the molten metal or alloy increasing its velocity until the zone of greatest width of the baffle (14).

5. A dip pipe according to claim 1, wherein said tube (6) is provided, at an upper portion thereof, with a flow control surface (7).

6. A dip pipe according to claim 1, wherein said tube (6) is directly flanged to the bottom of ladle (3), with a flow control surface being provided at the inside of the ladle.

7. A dip pipe according to claim 1, wherein said tube (6) is flanged to a flow control drawer device on the bottom of the ladle (3).

* * * * *